United States Patent [19]

Bartels et al.

[11] 4,016,928

[45] Apr. 12, 1977

[54] HEAT EXCHANGER CORE HAVING EXPANDED METAL HEAT TRANSFER SURFACES

[75] Inventors: Eugene L. Bartels, Kettering, Ohio; Robert B. Fleming, Scotia, N.Y.

[73] Assignee: General Electric Company, Schenectady, N.Y.

[22] Filed: Dec. 26, 1973

[21] Appl. No.: 428,075

[52] U.S. Cl. ..... 165/141; 165/154; 165/165; 165/179; 428/544

[51] Int. Cl.[2] ..... F28D 7/10

[58] Field of Search ..... 165/165, 166, 179, 141, 165/154; 29/195 P

[56] References Cited

UNITED STATES PATENTS

| | | | |
|---|---|---|---|
| 1,863,586 | 6/1932 | Wilke | 165/166 |
| 2,955,974 | 10/1960 | Allen et al. | 29/195 P |
| 3,228,460 | 1/1966 | Garwin | 165/154 |
| 3,409,075 | 11/1968 | Long | 165/154 |
| 3,477,504 | 11/1969 | Colyer et al. | 165/164 |
| 3,491,184 | 1/1970 | Rietdijk | 165/165 |
| 3,825,063 | 7/1974 | Cowans | 165/141 |

FOREIGN PATENTS OR APPLICATIONS

| | | | |
|---|---|---|---|
| 486,435 | 6/1938 | United Kingdom | 165/179 |
| 857,707 | 1/1961 | United Kingdom | 165/179 |

*Primary Examiner*—C. J. Husar
*Assistant Examiner*—Daniel J. O'Connor
*Attorney, Agent, or Firm*—Paul R. Webb, II; Joseph T. Cohen; Jerome C. Squillaro

[57] ABSTRACT

A heat exchanger core comprises a plurality of high conductivity expanded metal plates interleaved with a plurality of low conductivity separators configured and aligned to provide mutually isolated fluid flow channels across the expanded metal plates.

3 Claims, 4 Drawing Figures

HEAT EXCHANGER CORE HAVING EXPANDED METAL HEAT TRANSFER SURFACES

BACKGROUND OF THE INVENTION

1. Field of the Invention

This invention relates to heat exchangers. More particularly this invention relates to a heat exchanger core using expanded metal heat transfer surfaces for use in heat exchangers for cryogenic refrigeration systems.

This invention is related to the inventions disclosed and claimed in U.S. Pat. Nos. 3,477,504, issued Nov. 11, 1969 to Colyer and Fleming and 3,534,813 issued Oct. 20, 1970 to Fleming. These related patents are assigned as herein.

2. Prior Art

As indicated in the above-referenced U.S. Pat. No. 3,477,504, prior to the invention disclosed therein, heat exchangers of the tube type were commonly employed and constituted the prior art background of that invention. The above-referenced patents describe heat exchangers providing improved performance over the prior tube-type exchangers and comprising a plurality of perforated metal plates separated by thermally nonconductive separators in the core thereof. Subsequent to the development of these perforated plate heat exchangers, a second improved heat exchanger core construction was developed in which the perforated plate members are replaced by woven wire mesh members.

It is generally accepted that heat exchangers for use in cryogenic refrigeration systems should have very high thermal effectiveness and minimum size and weight. In order to provide very high thermal effectiveness, it is desired to have good flow distribution within the fluid streams, a low value of longitudinal heat conduction along the exchanger core, minimal (ideally no) fluid stream-to-fluid stream leakage, high heat transfer surface coefficients, and high heat transfer surface areas. In order to minimize weight, it is desirable to have heat transfer surfaces having substantial percentages of open area. It has been found that to maximize thermal effectiveness and minimize weight, approximately 70 percent open area is desirable in the heat transfer surfaces of a heat exchanger core. It is also desirable to provide a heat exchanger core construction which is structurally strong.

The perforated plate heat exchanger cores of the prior art are constructed by providing metal plates with perforations in a pattern corresponding to the fluid channels in the core and bonding the plates together with interleaved plastic separators of low conductivity, configured and aligned to provide the fluid flow channels. The perforated plate exchanger cores are therefore characterized by the abutting of a flat continuous metal surface with a flat continuous plastic surface. This construction provides for good fluid stream-to-fluid stream isolation and minimizes fluid leakage. On the other hand, the fabrication of perforated plate heat transfer surface elements results in higher costs than the use of wire mesh elements and has been found to be unable to economically practicably produce plates having more than 45 percent open area and therefore results in a heavier core. Moreover, the flat surface-to-flat surface metal-to-plastic bond characteristic of the perforated plate exchanger core has been found to produce insufficient structural bonding to maintain the structural integrity of the core after repeated cyclings without the use of additional compression elements to hold the plates and separators together. It was initially believed that such additional compression elements would not be necessary in perforated plate heat exchanger cores and in fact they were not found to be necessary on initial operation of perforated plate heat exchangers, however, after extensive hot-cold cycling, the differential thermal expansion between the heat transfer surface plates and the plastic separators was found to loosen the flat surface-to-flat surface bondings therebetween.

Wire mesh exchangers are less expensive to fabricate than perforated plate exchangers, typically provide the desired 70 percent open face area and consequently lower weight, and appear to provide improved structural bonding because of the ability of the separator material to at least partially penetrate the interstices of the portion of the mesh material between the separators. On the other hand, wire mesh exchangers have been found to suffer severe fluid stream-to-fluid stream leakage in some applications. Because the wire mesh is discontinuous even at crossing points and because the fine dimensions and complex geometry of the wire mesh prevent complete filling of interstices therein by plastic material, fine stream-to-stream leakage paths have proven unavoidable in practice. Since in some applications, stream-to-stream pressure differentials approximate 10 atmospheres, the isolation between channels of wire mesh heat exchanger cores is inadequate in those applications. This resulted in a degradation of thermal effectiveness of wire mesh heat exchangers in some applications to the extent that they are rendered completely unusable, which, of course, completely obviates their other advantages.

SUMMARY OF THE INVENTION

It is accordingly, an object of this invention to provide a heat exchanger core having high thermal effectiveness and low cost and weight.

It is another object of this invention to provide such heat exchanger core having additionally improved structural strength.

It is another object of this invention to provide such a heat exchanger core having heat transfer surfaces which are approximately 70 percent open and which are sufficiently sealed against stream-to-stream fluid leakage to retain high thermal effectiveness at stream-to-stream pressure differentials of 10 atmospheres.

Briefly, and in accordance with one embodiment of this invention, a heat exchanger core comprises a plurality of conductive heat transfer surfaces formed of expanded metal which heat transfer surfaces are interleaved with thermally insulating separator members configured and aligned to provide a plurality of mutually isolated fluid flow channels through the heat exchanger core. The separator material penetrates the interstices of the expanded metal material in the peripheral and interchannel regions of the core to provide a high level of fluid sealing and structural strength.

The novel features of this invention sought to be patented are set forth with particularity in the appended claims. The invention, together with further objects and advantages thereof, may be understood from a reading of the following specification and appended claims in view of the accompanying drawings in which:

DETAILED DESCRIPTION OF THE INVENTION

Figure 1:
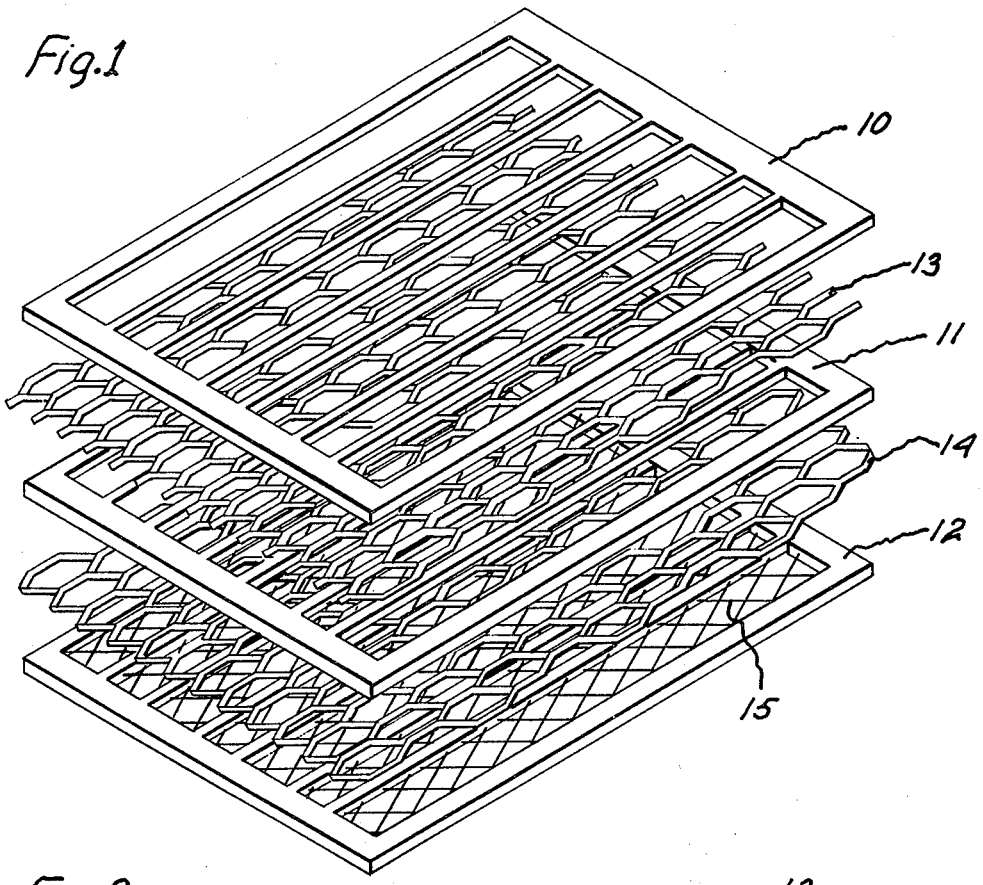
FIG. 1 is an exploded isometric view of a portion of a heat exchanger core in accordance with this invention with proportionality of parts distorted to illustrate details thereof.

FIG. 1 shows a portion of a heat exchanger core in accordance with this invention comprising three separator elements 10, 11, and 12 having expanded metal heat transfer surfaces 13 and 14 therebetween. In order to show details of the construction of the elements of the core clearly, FIG. 1 is an exploded view and additionally expanded metal members 13 and 14 are disproportionately enlarged with respect to separator members 10, 11, and 12.

Expanded metal is a well-known commercial item and is fabricated by cutting a plurality of rows of slits in sheet metal stock, the slits of each row of slits being offset from those of the adjacent rows by half the distance between slits, and then exerting a tensile stress across the sheet metal stock perpendicular to the slits therein to expand the metal by opening the slits. In this manner a structurally strong, mechanically continuous, metal structure having approximately 70 percent open area may be produced. Expanded metal may be formed from many metals. For the purposes herein, aluminum and copper are of the greatest interest. Aluminum has approximately one-half the thermal conductivity of copper and one-third the density of copper. On this basis, aluminum is preferred over copper for heat transfer surfaces 13 and 14 when minimum weight is desired, for example in airborne applications. Aluminum also has the advantages of being less expensive than copper and of forming a superior bond with the materials of separator elements 10, 11, and 12. On the other hand, in some applications, reduced volume of the heat exchanger core may be more desired than the saving in weight. In these cases, expanded copper heat transfer surfaces 13 and 14 are preferred. In these cases, the expanded copper material is preferably treated by a dip process in a bath of an oxidizing agent such as that sold under the trade name EBONOL-C to insure a uniform surface coating of black oxide on the copper to improve adhesion between the expanded copper plates and the material of the separator members. While a heat exchanger core in accordance with this invention utilizing expanded copper heat transfer surfaces is heavier and more expensive than the expanded aluminum version, it will be recognized by those skilled in the art that a degree of improved thermal efficiency will be obtained by using copper because the decreased volume and surface area of the heat exchanger results in a decrease of thermal leakage. Further, the increased cost of the heat exchanger core is partially offset by the ability to employ a smaller, and therefore a less expensive Dewar.

Separator members 10, 11, and 12 are formed of a thermally low conductivity material having plastic characteristics which provide for their bonding to the expanded metal heat transfer surface members to define fluid flow channels in the assembled core. The separators may comprise a thermosetting plastic material such as epoxy resin or a thermoplastic material such as polystyrene or a polycarbonate resin such as that sold under the General Electric Company trademark LEXAN. There would appear to be a fabrication advantage to using thermosetting materials for the separator members of the heat exchanger core in accordance with this invention in that the use of a thermosetting plastic would permit the fabrication of segments of the core as modules and the subsequent assembling of the desired number of modules into a finished core. The use of such a modular approach with thermoplastic spacer members is very much more difficult because of the softening of the members within each module when they are reheated to assemble a plurality of modules into a complete core. However, separators fabricated from thermosetting materials have been found to provide distinctly inferior stream-to-stream fluid isolation than is obtained using separators fabricated from thermoplastic materials. Accordingly, thermoplastic materials are preferred for the separators and particularly LEXAN polycarbonate resin is preferred because of its high strength among thermoplastics.

Figure 2:
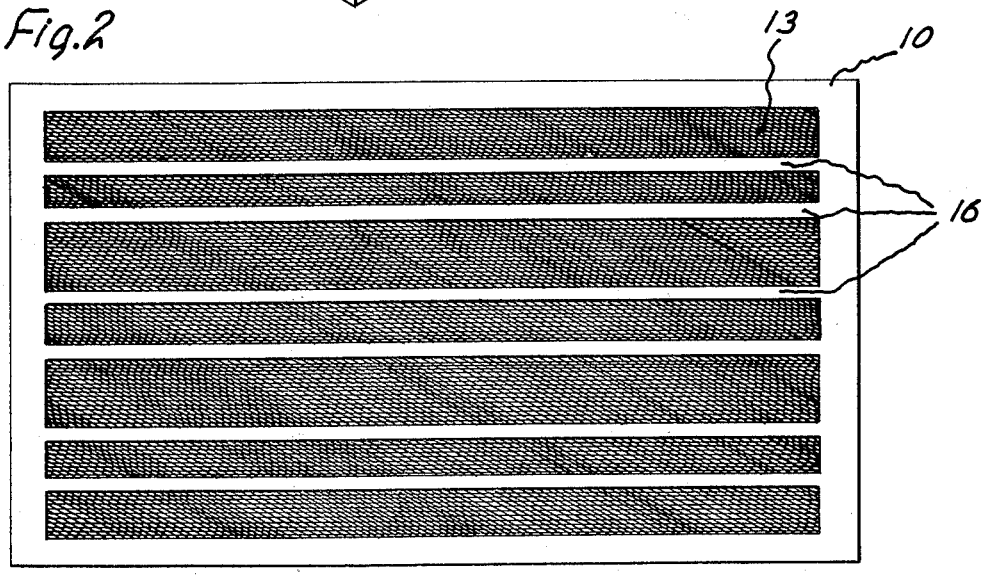
FIG. 2 is an orthogonal projection looking into a heat exchanger core in accordance with this invention and accurately illustrating proportionality of the parts.

FIG. 2 is an orthogonal view looking into a heat exchanger in accordance with this invention and showing separator member 10 having expanded metal heat transfer surface member 13 therebelow. FIG. 2 accurately depicts the dimensional proportionality between the separator member such as 10 in the heat exchanger core of this invention and the expanded metal heat transfer surface elements such as 13 in the heat exchanger core of this invention. Member 10 includes a peripheral portion and a plurality of transverse elements 16. The heat exchanger core in accordance with this invention is fabricated by interleaving a plurality of expanded metal members such as 13 with a plurality of separator members congruent to separator member 10, compressing the interleaved separators and expanded metal plates, and heating the compressed structure to cause the thermoplastic material of the separator members to penetrate the interstices of the expanded metal members at the points of contact between the expanded metal members and the peripheral portions and transverse portions 16 of the separator members to thereby form a structurally strong bond and fluid impenetrable bond therebetween. There is thereby provided a plurality of fluid flow channels in the heat exchanger core which are mutually thermally connected and fluid dynamically isolated from each other. As illustrated in FIG. 2, each channel typically has between five and twenty rows of openings exposed in each expanded metal heat transfer surface therein and each peripheral and transverse portion of the separator members has typically a width sufficient to cover between two and five rows of interstices in the expanded metal members to thereby form structurally and fluid dynamically strong seals in the finished core.

Figure 3:
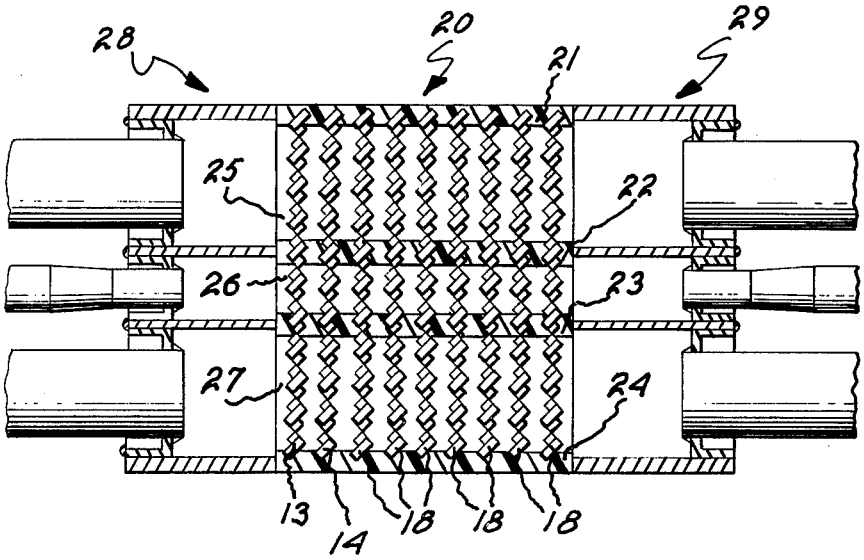
FIG. 3 is a cross-sectional view of a heat exchanger having a core in accordance with this invention.

FIG. 3 is a sectional elevation view of the heat exchanger employing a core in accordance with this invention. The finished heat exchanger core indicated generally at 20 comprises a plurality of expanded metal heat transfer surfaces 13, 14, and 18 bonded to quantities of separator material 21, 22, 23, and 24 to thereby form fluid flow channels 25, 26, and 27 through the core. Each fluid flow channel in core 20 is connected to a fluid conduit by header members indicated generally at 28 and 29. Thermally insulating fluid impervious separator material 21, 22, 23, and 24 prevent fluid leakage between channels 25, 26, and 27 and prevent longitudinal heat conduction along core 20. Heat transfer surfaces 13, 14, and 18 provide for efficient transverse thermal conduction between channels 25, 26, and 27.

Returning to FIG. 1, the separator members of this inventive heat exchanger core may consist of thermoplastic material as shown in FIG. 1, members 10 and 11, or alternatively, may comprise a molded body of thermoplastic material 12 having therein a coarse mesh 15 of monofilamentary material as, for example, nylon. The strand-to-strand spacing of mesh 15 is approximately one-quarter inch and so mesh 15 does not impede fluid flow within channels to any measurable extent. The purpose of mesh 15 is to improve the dimensional stability of separator member 12 during the compression and heating stages of the fabrication process for the heat exchanger core. Because longitudinal thermal conduction is to be avoided in a heat exchanger core, it is important to prevent heat transfer surfaces such as 13 and 14 from contacting each other. The inclusion of a mesh such as 15 in separator members is useful for preventing such contact. The use of mesh 15 however is not necessary and contact between heat transfer surfaces 13 and 14 can be prevented by separator 11 not including a mesh member if adequate care is taken in control of the core fabrication process.

Figure 4:
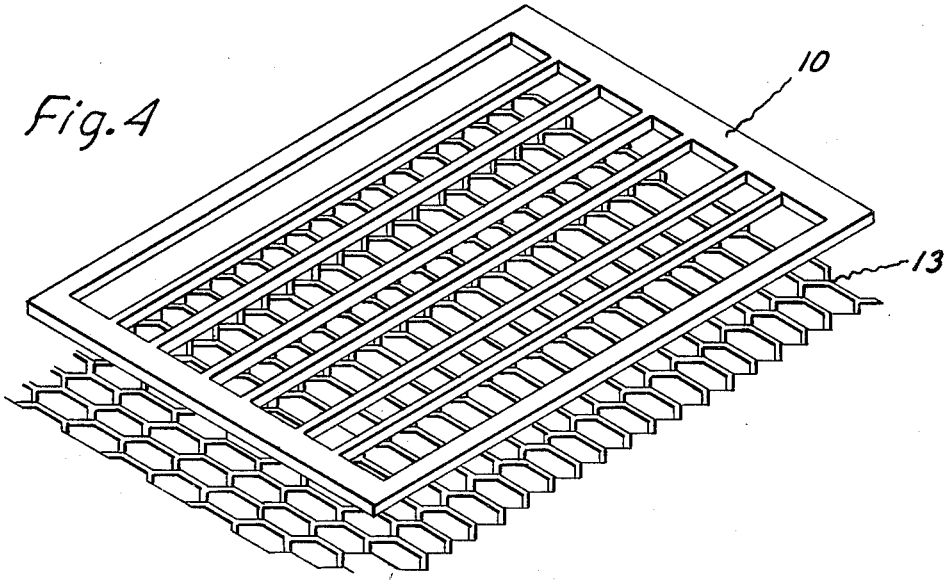
FIG. 4 is an isometric view comprising a portion of the core of FIG. 1 illustrating an alternative preferred orientation between the elements thereof.

FIG. 4 illustrates a preferred orientation between spacer members such as 10 and expanded metal heat transfer surface members such as 13 in cases of rectangular cores as shown. It will be noted that the orientation between these members as shown in FIG. 4 is offset 90° with respect to that orientation as shown in FIG. 1. Either orientation will provide satisfactory results in a heat exchanger core in accordance with this invention, however, it has been found that the expanded metal heat transfer surface elements have a preferred thermal conduction direction corresponding to the direction of the major dimension of the interstices therein. Accordingly, somewhat improved performance of a heat exchanger core in accordance with this invention is obtained by orienting the expanded metal heat transfer surface elements so that the major dimensions of the interstices therein are perpendicular to the transverse portions of the separator elements. This provides for the preferred heat transfer direction being from fluid stream-to-fluid stream rather than being along each fluid stream, and therefore results in some operational improvement. This invention also contemplates cylindrical heat exchanger cores. In the case of cylindrical cores, of course, the orientation is not significant in determining core performance since all orientations occur at some point in the core.

It may thus be seen that this invention provides a novel heat exchanger core which has superior fluid stream-to-fluid stream isolation over prior wire mesh heat exchangers and superior structural strength, lighter weight, and lower cost than prior perforated plate exchangers.

While this invention has been described with reference to particular embodiments and examples, other modifications and variations will occur to those skilled in the art in view of the above teachings. Accordingly, it should be understood that within the scope of the appended claims, the invention may be practiced otherwise than is specifically described.

The invention claimed is:

1. A heat exchanger core for transferring heat between at least two counterflowing fluid streams comprising a plurality of high conductivity expanded metal members, each such member with a mechanically continuous structure having a plurality of interstices and having approximately 70 percent open area, said interstices having major and minor axes, a plurality of low conductivity thermoplastic separators interleaved with said expanded metal members, each separator having a rectangular shape and a peripheral portion and transverse elements defining fluid flow channels, said separator members and said expanded metal members oriented with respect to each other such that the major axes of said interstices are perpendicular to said transverse portions, the material of the separator penetrating the interstices of the expanded metal members at the points of contact between the expanded metal members and peripheral portion and transverse elements of the separators, the separator material thereby bonding the separator to the expanded metal members, and the separators being aligned, thereby providing at least a pair of mutually isolated fluid flow channels through the heat exchanger core.

2. The heat exchanger core of claim 1 in which each separator is a molded body of thermoplastic material including a coarse mesh therein to improve the dimensional stability thereof.

3. The heat exchanger core of claim 2 in which the thermoplastic material is a material selected from the group consisting of polycarbonate resin and polystyrene; and the coarse mesh is nylon.

* * * * *